United States Patent [19]

Nagy et al.

[11] Patent Number: 4,769,655

[45] Date of Patent: Sep. 6, 1988

[54] VEHICLE SLOT ANTENNA WITH PASSIVE GROUND ELEMENT

[75] Inventors: Louis L. Nagy, Warren; Jimmy L. Funke, Mt. Clemens, both of Mich.

[73] Assignee: General Motors Corporation, Detroit, Mich.

[21] Appl. No.: 49,600

[22] Filed: May 14, 1987

[51] Int. Cl.[4] ..... H01Q 1/32

[52] U.S. Cl. ..... 343/712; 343/713; 343/769

[58] Field of Search ..... 343/712, 713, 700 MS, 343/702, 767, 768, 769, 829, 846

[56] References Cited

U.S. PATENT DOCUMENTS

| | | | |
|---|---|---|---|
| 2,094,168 | 9/1937 | Forbes | 343/713 |
| 4,005,429 | 1/1977 | Ikrath et al. | 343/713 |
| 4,023,179 | 5/1977 | Ikrath et al. | 343/713 |
| 4,707,700 | 11/1987 | Nagy | 343/712 |
| 4,721,963 | 1/1988 | Nagy et al. | 343/712 |

*Primary Examiner*—William L. Sikes
*Assistant Examiner*—Doris J. Johnson
*Attorney, Agent, or Firm*—Robert M. Sigler

[57] ABSTRACT

An FM antenna for a vehicle with a ground plane comprising a horizontal roof having supporting pillars at the front and rear corners comprises a side fed, looped, annular slot antenna in the roof of loop length substantially one wavelength in the commercial FM broadcasting band, the slot antenna being displaced from the center of the roof toward one of the front and rear of the roof. An opening is formed in the ground plane adjacent the slot antenna effective to force ground currents around it toward the pillars at the corners in the other of the front and rear of the roof; and an aperture wire discontinuity in the opening of the ground plane, in the form of a finger of the ground plane projecting from the edge of the opening adjacent the slot antenna toward the other of the front and rear of the roof, provides a passive, lumped ground impedance element which modifies the phase relationships of the ground currents in the pillars at the front and rear corners of the roof to reduce directionality in the vertically polarized FM radiation/reception pattern of the slot antenna.

1 Claim, 2 Drawing Sheets

SLOT ANTENNA WITH PASSIVE GROUND ELEMENT

SLOT ANTENNA WITHOUT PASSIVE GROUND ELEMENT

IMPEDANCE WITH AND WITHOUT PASSIVE GROUND ELEMENT

VEHICLE SLOT ANTENNA WITH PASSIVE GROUND ELEMENT

BACKGROUND OF THE INVENTION

This invention relates to a non-cavity backed slot antenna for a motor vehicle, and particularly to such an antenna in the roof of the vehicle. Such an antenna, being part of the vehicle body structure, is somewhat dependent on that structure for its reception characteristics, including directionality. It is desirable for any vehicle mounted antenna to be non-directional, since the vehicle does not maintain a fixed position or attitude with respect to signal sources. Generally, it is desirable to maintain a directionality standard such as no more than 15 dB between the maximum and minimum signal strength angles in the commercial FM band. This is not always attained with a slot antenna. Several methods of redesigning the slot antenna to decrease directionality, such as changing the antenna feed point, repositioning the slot or changing the geometric shape of the slot, all tend to have adverse effects on the antenna's other operating characteristics such as overall FM gain, FM bandwidth, or AM gain.

In a non-cavity backed, vehicle roof mounted, slot antenna, the pillars supporting the roof affect the vertical polarization of the radiation/reception characteristics. If the ground currents through the roof support pillars can be brought into an optimum phase relationship and amplitude relationship, the vertical polarization pattern can be made less directional.

SUMMARY OF THE INVENTION

An improvement in antenna directionality has been found by modifying the antenna's ground plane. The ground plane for a vehicle roof mounted slot antenna is the vehicle roof outside the slot and the vertical pillars, particularly those at the front and rear corners of the roof. It has been found that the formation of an opening in the ground plane effective to steer ground currents toward chosen pillars along with an aperture wire discontinuity in the ground plane into which ground current energy is guided can fill in the null spots in the antenna radiation/reception pattern. In particular, where the slot antenna is a side fed, looped annular slot in the ground plane having a loop length of substantially one wavelength in the commercial FM broadcasting band and is displaced from the center of the roof toward one of the front and rear of the roof, the opening may be located in the ground plane adjacent the slot antenna but displaced therefrom toward the other of the front and rear of the roof so that ground currents are forced toward the corners at the other of the front and rear of the roof. In addition, the aperture wire discontinuity may comprise a narrow finger of the ground plane projecting into the opening from the edge adjacent the slot antenna toward the other of the front and rear of the roof, the finger thus comprising a passive, lumped ground impedance element modifying the phase and amplitude relationships of the ground currents in the pillars to reduce directionality in the vertically polarized FM radiation/reception pattern of the slot antenna.

Thus, the slot antenna can be designed for maximum overall FM gain, AM gain or FM bandwidth, with the directionality improved substantially independently of the other, previously mentioned characteristics.

DESCRIPTION OF A PREFERRED EMBODIMENT

Figure 1:
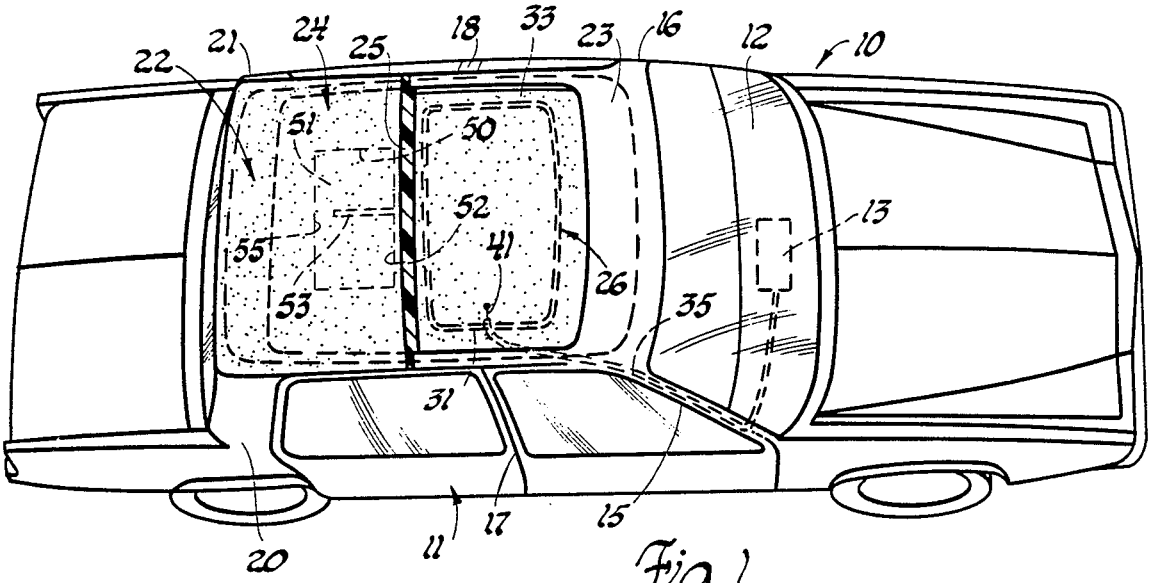
FIG. 1 shows a perspective drawing of a motor vehicle having a roof mounted slot antenna with a passive ground element according to the invention.

Referring to FIG. 1, a motor vehicle 10 has a lower body portion 11 including a dashboard 12 behind or within which is a standard Am-FM radio receiver 13. A plurality of roof pillars 15, 16, 17, 18, 20, 21 rise in a substantially vertical direction from lower body portion 11 to support a vehicle roof 22.

Vehicle roof 22 has an outer electrically conducting portion 23 typically made of steel rails connected to and supported by roof pillars 15–21. A non-conducting roof panel 24 made of a sheet molded compound (SMC) plastic resin overlaps portion 23 and comes part of the way down the vertical pillars, if necessary, to provide a smooth roof surface with no visible discontinuities. The center portion of panel 24, as defined by the inner boundary of conducting portion 23, comprises an inner, non-conducting portion 25 of roof 22. Since panel 24 covers the entire roof of the vehicle and is painted to match the remainder of the vehicle or covered with a vinyl top, there is no trace of the antenna in the external appearance of the vehicle and no wind resistance therefrom.

Figure 4:
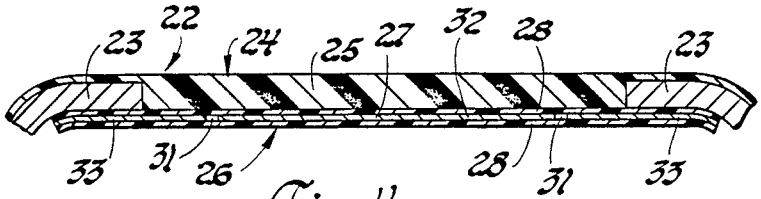

The antenna lies just below the vehicle roof as shown in FIG. 4. In this embodiment it comprises a flexible sheet 26 comprising an electrically conducting aluminum foil 27 sandwiched between layers 28 of insulating plastic resin. The thickness of the sheet is exaggerated in FIG. 4, and the layers are not shown in true proportional thickness; but FIG. 4 does show the overlap of sheet 26 including its conducting layer under the metal portion 23 of the roof. The overlap extends entirely around the roof as seen in FIG. 1, although only the sides are shown in FIG. 4.

Figure 3:
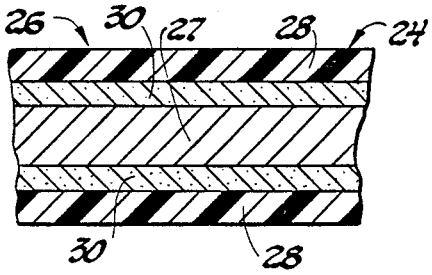
FIGS. 3 and 4 show vertical section views through a portion of the antenna of FIG. 1, with FIG. 3 being an enlarged view of a portion of FIG. 4.

A clearer and more accurate representation of the cross-section of sheet 26 than is possible in FIG. 4 is shown in FIG. 3. The electrically conducting layer 27 is shown at the center of the sandwich, with insulating layers 28 attached thereto by adhesive layers 30. Electrically conducting layer 27 may be aluminum foil, although a material with a higher sheet resistance may be used to reduce the voltage standing wave ratio (VSWR).

The conducting layer 27 of sheet 26 is not continuous. There is a rectangularly looped slot 31 having a width of about one quarter inch (6.4 mm) and a circumference of about one wavelength in the commercial FM band (approximately 128 inches or 3.25 meters) which divides layer 27 into inner 32 and outer 33 portions. The actual dimensions of the slot are 39 inches (0.99 meter) across the roof and 25 inches (0.64 meter) from front to back; and the corners are rounded or angled. Inner portion 32 and slot 31 lie entirely beneath the non-conducting portion 25 of roof 22. Outer portion 33 lies partially beneath the non-conducting portion 25 and partially beneath the conducting portion 23 of roof 22. Outer portion 33 is preferably clamped tightly against conducting portion 23 of roof 22 to bring the conducting surfaces as close together as possible and thus maximize the capacitive coupling therebetween for ground plane formation. This clamping should be effectively continuous around the circumference of the antenna.

Figure 2:
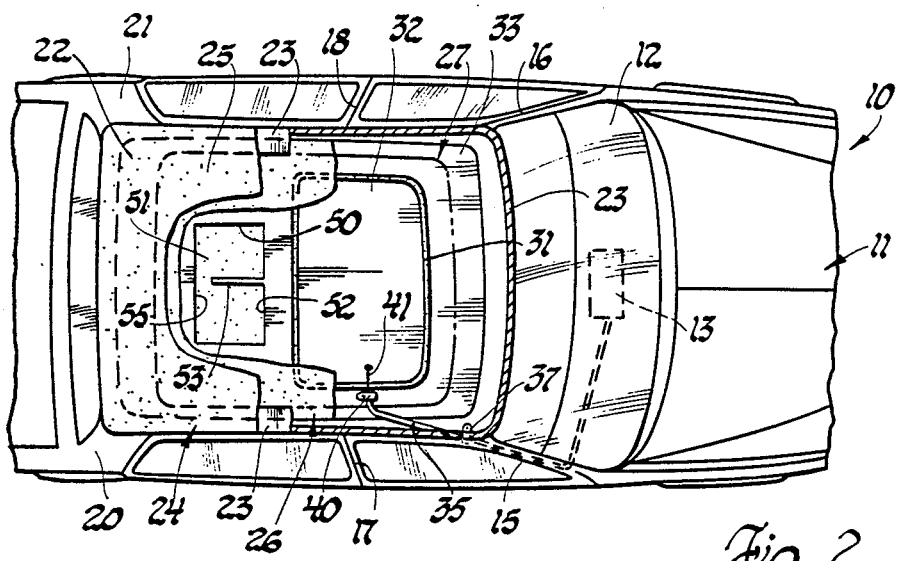
FIG. 2 shows a top view of a portion of the vehicle of FIG. 1 with the roof portion partially cut away to show the antenna in greater detail.

The feed and ground connections of the antenna for a common AM-FM feed are shown in FIG. 2. A coaxial cable 35 extends from radio receiver 13 across the dash area under or behind dashboard 12 to the bottom of the right front pillar 15. It is routed up pillar 15 to the right front corner of the roof (metal roof at this location), where a portion of the outer insulation is stripped and the braided outer or ground conductor thereof is clamped to the roof for electrical conduction therebetween by a clamp 37. This location for a DC and AM ground connection is determined from the vehicle body standing wave pattern to be a voltage null. Cable 35 further extends back along the side of the roof to a point about at the middle of the side of slot 31. From here it is routed across to the slot for a side feed thereto. Cable 35 is anchored on outer portion 33 adjacent slot 31 by a clamp 40, with the outer conductor of cable 35 again grounded for DC and AM grounds; and inner conductor 41 of cable 35 extends across slot 31 to be attached to inner portion 32.

As already mentioned, outer portion 33 of layer 27 lies partially beneath the non-conducting portion 25 and partially beneath the conducting portion 23 of roof 22. This overlap extends entirely around the circumference of the roof and provides capacitive coupling between the outer or ground portion 33 of layer 27 of the antenna and the electrically conducting portion of the vehicle body, which coupling establishes an FM signal ground for the antenna.

The outer portion 33 of layer 27, forms a portion of the ground plane of the antenna, which ground plane is continued in the conducting portion 23 of the vehicle roof, to which conducting portion outer portion 33 is coupled, and further extends through pillars 15, 16, 17, 18, 20, and 21 to lower body portion 11. Behind slot 31, with reference to the front of vehicle 10, outer portion 33 has an opening 50 which defines an additional portion 51 of layer 27 which is non-conducting. Opening 50 is, in this embodiment, rectangular in shape and somewhat smaller than inner portion 32. It's dimensions are, in this embodiment, 0.61 meters (24 inches) wide across the vehicle and 0.38 meters (15 inches) from front to back. It is so formed and placed as to be effective to steer ground currents to the rear pillars 20 and 21. From the center of the front edge 52 of opening 50, a finger 53 of conducting material approximately 25 millimeters (1 inch) wide extends directly backward into opening 50 approximately 0.28 meters (11 inches), somewhat short of the rear edge 55 thereof. Finger 53 is an aperture wire continuity comprising a passive, lumped, ground impedance element in the ground plane of the slot antenna which is effective to modify the phase and amplitude relationships of the ground currents in the pillars, particularly those in the front (15, 16) and rear (20, 21) corners of the roof, to reduce directionality in the vertically polarized FM radiation/reception pattern of the slot antenna.

Figure 5:
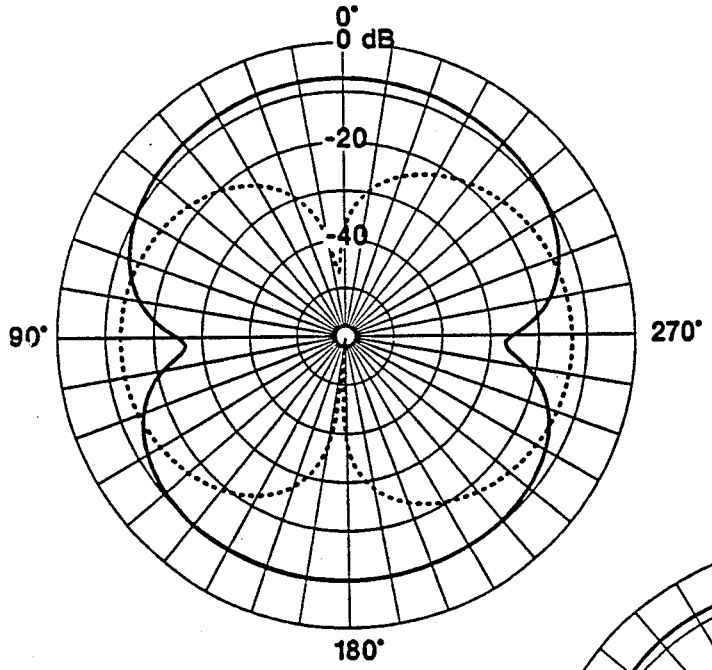
FIGS. 5 and 6 show the directional radiation/reception amplitude patterns for a slot antenna with and without the passive ground element.
Figure 6:
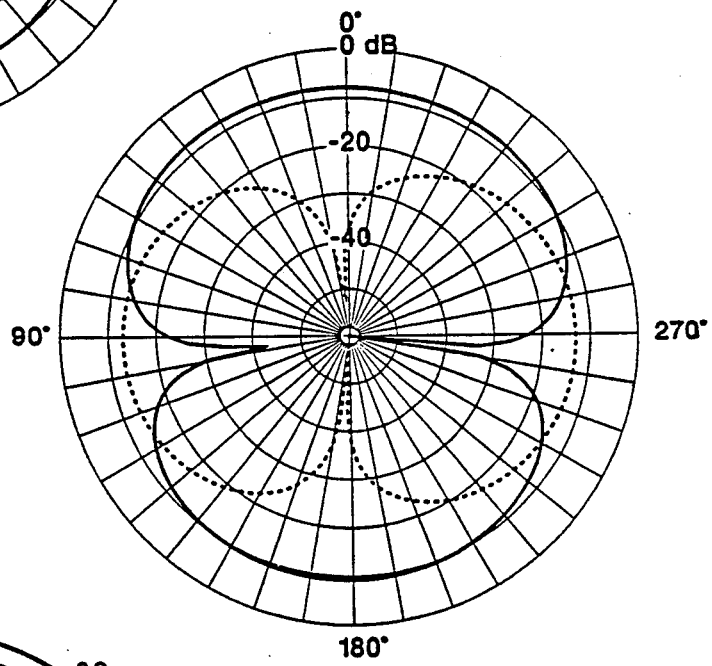
Figure 7:
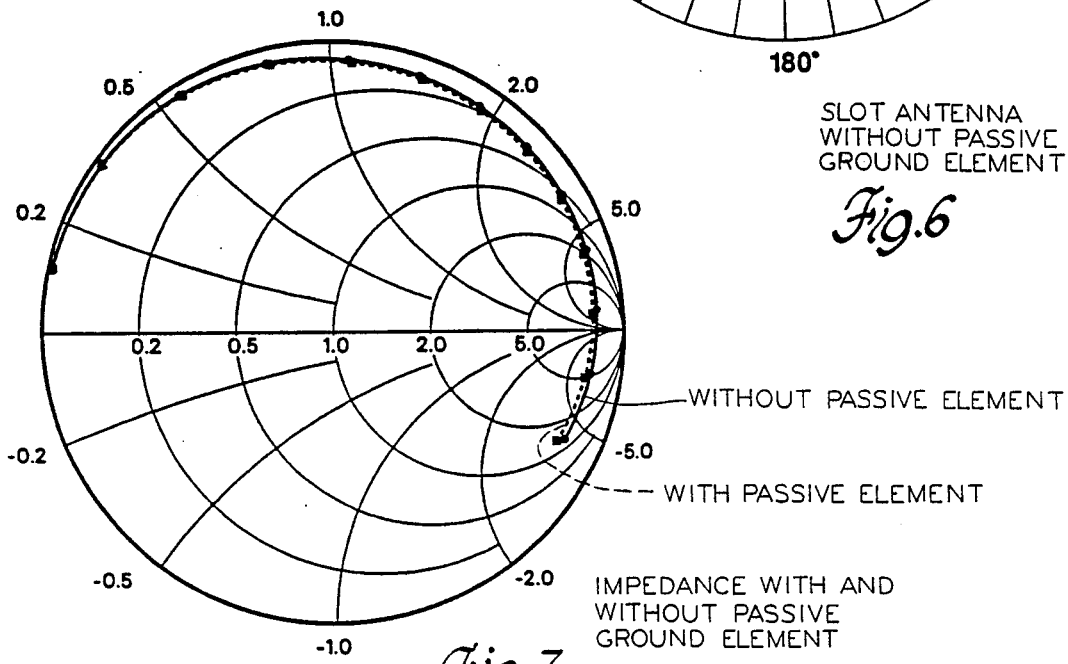
FIG. 7 shows an impedance chart for a slot antenna with and without the passive ground element.

The improvement in directionality in the antenna with passive ground element 53 in opening 50 can be seen by comparing the plots of FIGS. 5 and 6. The vertical FM polarization is shown in these Figures by the solid line, and the horizontal FM polarization by the dashed line. In the plot of FIG. 6, the vertically polarized radiation/reception pattern without the passive ground element shows substantial nulls near 90 and 270 degrees. These nulls are greatly reduced by the passive ground element, as shown in the plot of FIG. 5, with directionality greatly improved. This is accomplished without significantly affecting the impedance plot, as seen in FIG. 7 wherein the solid and dashed lines show impedance plots with and without the passive ground element 53 to be substantially identical, or the overall FM reception sensitivity, as seen in FIGS. 5 and 6.

The embodiments of the invention in which an exclusive property or privilege is claimed are defined as follows:

1. An FM antenna for a vehicle having a body and a substantially rectangular, horizontal roof supported above the body by substantially vertical pillars at the front and rear corners thereof, the roof and pillars comprising a ground plane of conducting material with ground currents therein, the antenna comprising, in combination:

a side fed, looped, annular slot antenna in the roof, the slot antenna having a loop length of substantially a wavelength in the commercial FM broadcasting band and being displaced from the center of the roof toward one of the front and rear of the roof;

an opening in the ground plane adjacent the slot antenna and somewhat smaller in size but displaced therefrom toward the other of the front and rear of the roof;

a narrow finger of the ground plane projecting into the opening from the center of the edge adjacent the slot antenna toward the other of the front and rear of the roof, the antenna with the opening and narrow finger having reduced directionality in its vertically polarized FM radiation/reception pattern.

* * * * *